United States Patent [19]

Tsuchikawa et al.

[11] 4,334,824

[45] Jun. 15, 1982

[54] FLEXIBLE FAN DEVICE

[75] Inventors: Shunzo Tsuchikawa, Ichinomiya; Masaharu Hayashi, Toyota, both of Japan

[73] Assignee: Aisin Seiki Kabushiki Kaisha, Kariya, Japan

[21] Appl. No.: 169,667

[22] Filed: Jul. 17, 1980

[30] Foreign Application Priority Data

Jul. 27, 1979 [JP] Japan ..... 54-104465[U]

[51] Int. Cl.[3] ..... F04D 29/38

[52] U.S. Cl. ..... 416/132 R; 416/238; 416/240

[58] Field of Search ..... 416/132 R, 132 A, 240 R, 416/238, 243

[56] References Cited

U.S. PATENT DOCUMENTS

| | | | |
|---|---|---|---|
| 152,973 | 7/1874 | Cross | 416/238 |
| 463,908 | 11/1891 | Morton | 416/238 |
| 578,360 | 3/1897 | Phillips et al. | 416/238 |
| 736,137 | 8/1903 | McIntosh | 416/132 R |
| 958,599 | 5/1910 | Cooksey | 416/238 |
| 1,158,909 | 8/1910 | Evitts | 416/238 |
| 1,798,299 | 3/1931 | Antoni | 416/132 X |
| 3,584,969 | 6/1971 | Aiki et al. | 416/132 |
| 3,860,362 | 1/1975 | Bentley et al. | 416/132 |
| 4,187,055 | 2/1980 | Barnstead | 416/132 A |

FOREIGN PATENT DOCUMENTS

| | | | |
|---|---|---|---|
| 2013481 | 10/1970 | Fed. Rep. of Germany | 416/132 |
| 303021 | 1/1955 | Switzerland | 416/132 R |
| 4560 | of 1910 | United Kingdom | 416/132 A |
| 28673 | of 1910 | United Kingdom | 416/132 A |

*Primary Examiner*—Everette A. Powell, Jr.

*Attorney, Agent, or Firm*—Finnegan, Henderson, Farabow & Garrett

[57] ABSTRACT

A flexible fan device includes a power driven boss and a plurality of fan blades, each secured on the boss at an attached angle. The fan blade has a root portion secured to the boss and a tip portion offset with respect to the root portion in the downstream direction so that the blade angle is decreased under the influence of centrifugal force in response to an increase in the rotating speed. The fan blade is formed to have an angle inclined in the direction of rotation of the boss.

2 Claims, 3 Drawing Figures

FLEXIBLE FAN DEVICE

The present invention relates to a fan device and more particularly to a flexible fan device in which the angles of the fan blades are centrifugally varied in accordance with the rotating speed of the fan device.

Flexible fan devices in automobiles are designed so that the angles of the fan blades are decreased in response to an increase in the rotating speed to thereby decrease noise and power consumption. In order for the angle of the fan blade to be decreased under the centrifugal force, the blade has been conventionally formed with a cut-off portion at the trailing root portion thereof. Thus, the blade is flexibly twisted under the influence of the centrifugal force in accordance with the rotating speed of the fan to change the angle thereof. However, such conventional fan devices have disadvantages in that the blades are weakened due to the cut-off portions.

It is therefore an object of the present invention to provide a flexible fan device which does not have cut-off portions in the fan blades.

Another object of the present invention is to provide a flexible fan device having fan blades which are so formed that they can be twisted under centrifugal force to change their attack angles in accordance with the rotating speed thereof.

According to the present invention, the above and other objects can be accomplished by a flexible fan device comprising a power-driven rotating boss having an axis of rotation and a plurality of flexible blades extending radially outward therefrom, each of the blades having a root portion and a tip portion, the root portion gradually curving away in the downstream direction from a plane perpendicular to the axis of rotation to form an attachment angle of the root portion to the boss, wherein the tip portion is axially offset from the root portion toward the downstream side, the trailing edge of the tip portion is axially offset farther than the leading edge of the tip portion, and both the leading edge and the trailing edge of the tip portion lie on the downstream side of a plane through the center of the root portion and perpendicular to the axis of rotation, the cross-section of the blade thereby forming an S curve, whereby each blade is flexibly twisted under a centrifugal force so that the tip portion of each blade makes a variable angle with respect to the plane perpendicular to the axis of rotation of the boss means, the variable angle decreasing in response to an increase in speed of rotation of the boss means.

According to the present invention, the blade twisting effect is produced by the axial offset of the tip portion of the blade so that it is unnecessary to provide a cut-off or any other portion which may weaken the blade.

The above and other objects and features of the present invention will become apparent from the following descriptions of a preferred embodiment with reference to the accompanying drawings, in which.

Figure 1:
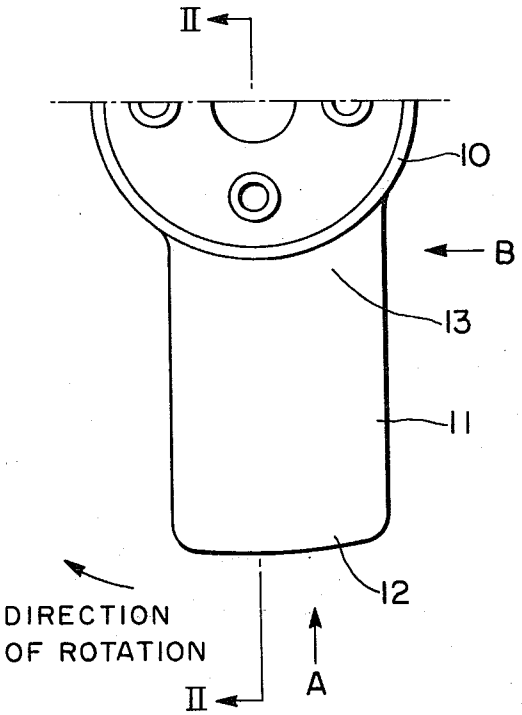
FIG. 1 is a fragmentary front view of a flexible fan device embodying the features of the present invention.
Figure 2:
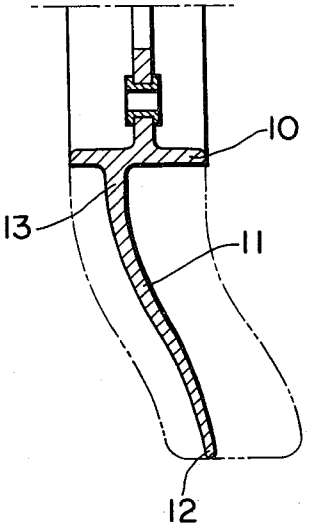
FIG. 2 is a sectional view taken along a line II—II in FIG. 1.

Referring now to the drawings, there is shown a flexible fan device including a fan boss 10 which is adapted to be driven by a suitable power source such as an internal combustion engine. On the fan boss 10, there are secured a plurality of fan blades 11 each blade having a tip portion 12 and a root portion 13, the latter being attached to the boss 10 with an attachment angle A with respect to a plane P which is perpendicular to the axis L of the fan boss 10. In FIG. 2, it will be noted that the tip portion 12 is offset with respect to the root portion 13 in the direction of the axis L of the fan boss 10. In the illustrated embodiment, the offset is in the direction of air flow so that a leading edge 14 of the blade tip portion 12 is axially offset toward the downstream side with respect to a center line of twist X of the blade by a distance a. Further, the fan blade 11 is formed to have an inclined angle $\alpha$ in the direction of rotation of the boss 10 (see FIG. 3). Thus, a trailing edge 15 of the blade tip portion 12 is axially offset from the twist center line X by a distance b which is greater than the distance a. Thus, an S curve is formed in the direction of air flow through the fan device.

Figure 3:
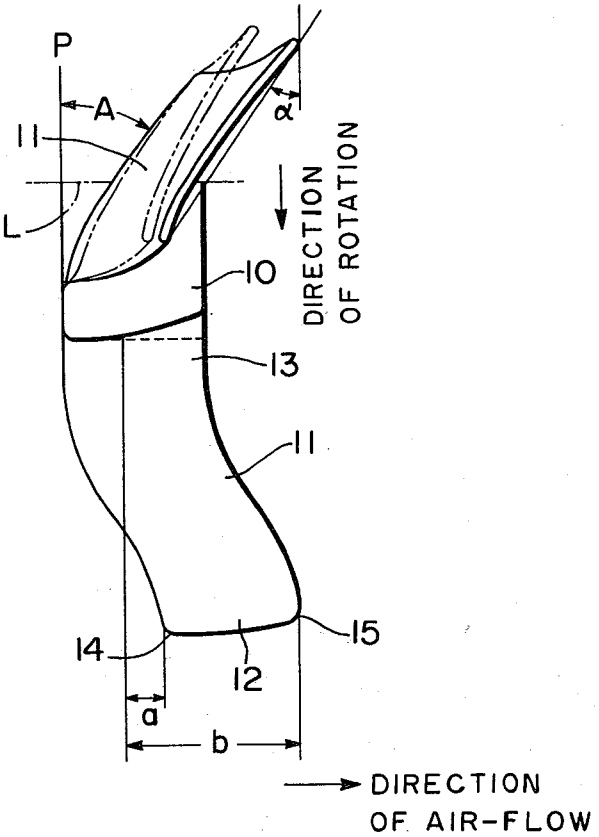
FIG. 3 is a view showing the fan blades as illustrated along arrows A and B in FIG. 1.

It will therefore be understood that the centrifugal force produced in the blade 11 serves to twist the tip portion 12 counterclockwise in the plane of FIG. 3. Since the centrifugal force increases in response to an increase in the speed of rotation of the fan boss 10, an increase in the rotating speed causes a decrease in the angle of the tip portion 12 of the blade 11 with respect to the plane P as shown by phantom lines in FIG. 3. Thus, the pitch angle of the blade can be automatically changed in accordance with a change in the rotating speed.

The invention has thus been shown and described with reference to a specific embodiment, however, it should be noted that the invention is in no way limited to the details of the illustrated embodiment but changes and modifications may be made. It is intended that the present invention cover such changes and modifications of this invention that come within the scope of the claims and their equivalents.

We claim:

1. A flexible fan device comprising: a power-driven rotating boss having an axis of rotation and a plurality of flexible blades extending radially outward therefrom, each of said blades having a root portion and a tip portion, the root portion gradually curving away in the downstream direction from a plane perpendicular to said axis of rotation to form an attachment angle of said root portion to said boss, wherein said tip portion is axially offset from said root portion toward the downstream side, the trailing edge of said tip portion is axially offset farther than the leading edge of the tip portion, and both the leading edge and the trailing edge of said tip portion lie on the downstream side of a plane through the center of said root portion and perpendicular to said axis of rotation, the cross-section of said blade thereby forming an S curve, whereby each blade is flexibly twisted under a centrifugal force so that the tip portion of each blade makes a variable angle with respect to the plane perpendicular to the axis of rotation of the boss means, said variable angle decreasing in response to an increase in speed of rotation of the boss means.

2. Flexible fan device in accordance with claim 1, in which each of said blades is so arranged that the tip portion is in parallel to the root portion and extends outwardly in a straight form as seen from the upstream side of air flow through the fan device.

* * * * *